United States Patent [19]

Schöttle et al.

[11] 4,043,264

[45] Aug. 23, 1977

[54] PRINTING DEVICE

[75] Inventors: Helmut August Michael Schöttle; Karl-Heinz Harry Strobel, both of Berlin, Germany

[73] Assignee: Adrema Pitney Bowes GmbH, Heppenheim, Bergstrasse, Germany

[21] Appl. No.: 651,837

[22] Filed: Jan. 23, 1976

[30] Foreign Application Priority Data

Jan. 31, 1975 Germany ..... 2504018

[51] Int. Cl.[2] ..... B41F 3/04

[52] U.S. Cl. ..... 101/269

[58] Field of Search ..... 101/45, 56, 269–274, 101/111, 426

[56] References Cited

U.S. PATENT DOCUMENTS

| | | | |
|---|---|---|---|
| 1,118,814 | 11/1914 | Schmidt et al. | 101/111 |
| 2,026,115 | 12/1935 | Anthony | 101/274 |
| 2,848,943 | 8/1958 | Simons | 101/269 |
| 3,340,800 | 9/1967 | Grover et al. | 101/269 X |
| 3,572,241 | 3/1971 | Waterman | 101/269 |
| 3,673,960 | 7/1972 | Ricci et al. | 101/269 |
| 3,838,641 | 10/1974 | Mcinnis | 101/269 |
| 3,874,291 | 4/1975 | O'Reilly et al. | 101/269 |
| 3,901,144 | 8/1975 | Deutsch | 101/272 X |
| 3,905,293 | 9/1975 | See et al. | 101/56 |

*Primary Examiner*—Edward M. Coven
*Attorney, Agent, or Firm*—Peter Vrahotes; William D. Soltow, Jr.; Albert W. Scribner

[57] ABSTRACT

This invention relates to a manual printing device of the type for printing onto a print medium of the kind comprising at least one form and an ink transferring ribbon or the like associated with it. The printing device has a printing anvil serving as support for the print medium and a plate having raised characters. The printing plate is preferably made of plastic. The printers have a printing head which is moved across the print medium and plate to cause imprinting upon the print medium.

4 Claims, 4 Drawing Figures

FIG. 1
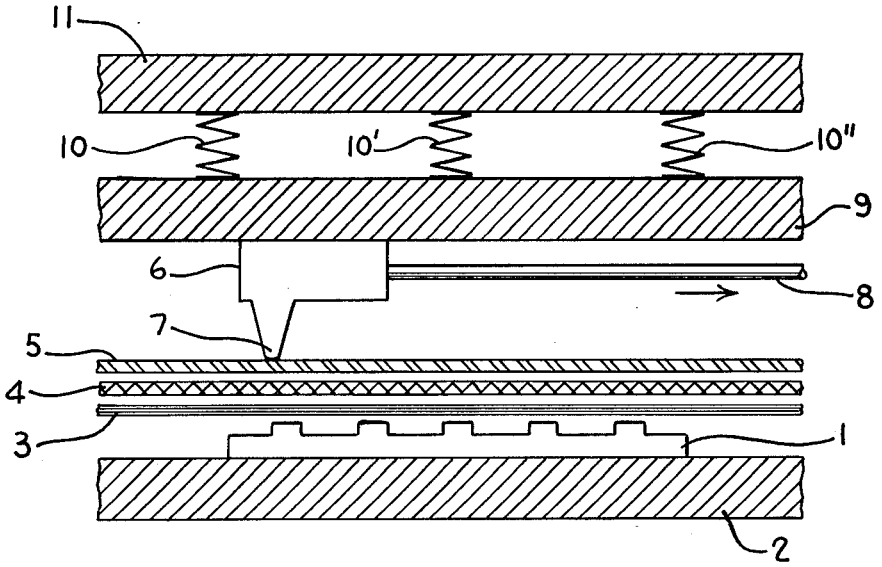
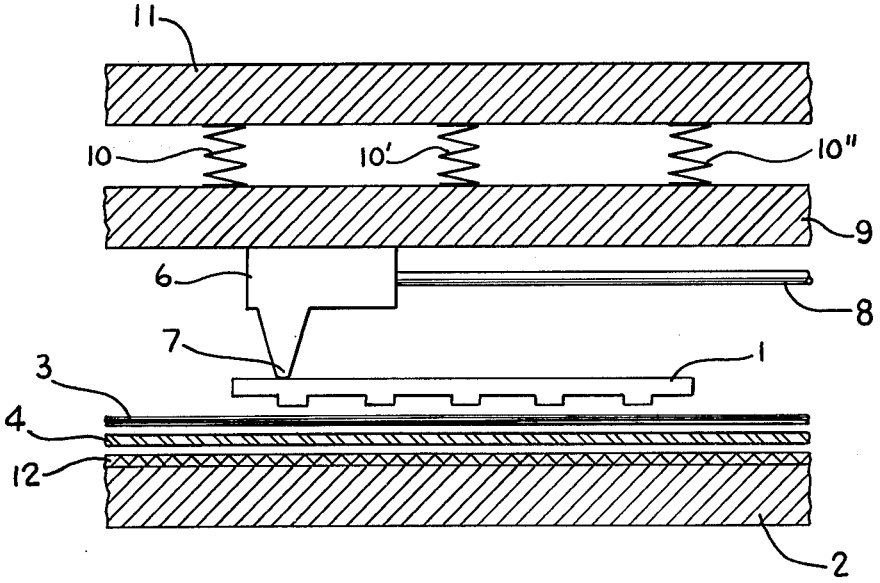
FIG. 2

PRINTING DEVICE

BACKGROUND OF THE INVENTION

Manual printing devices of the kind used for printing forms through use of a plate, such as a credit card, are well known in the art. Examples of such printing devices are described in U.S. Pat. No. 3,417,691 and German patent specification DT-OS 2 154 117. Such printing devices are generally provided with a print roller which is moved across a printing surface to obtain satisfactory ink transfer. Endeavoring to attain a reduced weight for a portable hand printing device, the forces of impression have had to be reduced substantially. The contact pressure between the printing plate and the printing roll depends upon the extent of the contact surface, so that the required forces are much lower using small or hard printing rolls. The endeavors for reducing the diameter of the printing roll, as a consequence of the above considerations, are bound by certain limitations. For example, reducing the diameter of the printing roll increases the danger of bending therefore making it no longer possible to obtain satisfactory impressions.

SUMMARY OF THE INVENTION

According to the instant invention, an improved printing device is provided which is especially small, very flat, light and, therefore, easy to transport and by means of which high quality impressions are attainable which are machine-readable.

The printing device according to the instant invention is essentially characterized in that the printing element has a spring loaded printing batten having a small printing ridge that produces a high specific surface pressure. This invention, therefore, is based on the fundamental idea of using, in lieu of a print roller, a rigid printing batten which by means of its sharp ridge makes it possible, in spite of a low contact force (force of impression), to attain a sufficiently high specific contact pressure when it is moved the printing plate and the form, or set of forms.

It has been found very suitable from a construction point of view to have the printing batten supported by a spring-loaded guide track.

The printing device according to the invention is further characterized in that a housing has a printing anvil fixed at its bottom part and a spring-loaded guide track fixed at its upper part which is pivotally connected to the bottom part by means of a hinge. As has been found, by using such a construction an especially flat design can be attained, which, moreover, simplifies delivery of the forms to the printing anvil.

In a very advantageous manner, the printing batten is hand-operable by means of a pull rod connected to it, which pull rod extends out of the side of the housing. The pull rod, is supplied with a return spring.

It has been found advantageous to have the guide track formed as a U-shaped support. A printing plate is passed through a recess in the side of the housing and is pushed onto a support on the front portion of guide rails which are formed as arm sections of the guide track.

A very practical manner of handling the printer is attained by connecting to the printing batten an ejector claw which is effective on its return stroke to pick up the printing plate, and remove it from the support and out of the recess of the housing. This design is, moreover, characterized in that a knuckle lug is connected to the guide track and extends in the path of the return stroke in such a manner that in the starting or home position of the printing batten, the ejector claw is moved sidewards to enable a new plate to be inserted.

In order to render it possible for the housing to be automatically opened for enabling a form to be replaced after an impression has been made, the housing has pivotally connected parts interposed by a leaf spring which is effective to open the housing. At least one locking clasp is associated with the upper part of the housing for the opening operation. It has been found very suitable in this connection to provide a locking bar with a shoulder in the feed path of the printing batten. After the printing operation has been performed, the printing batten abuts the shoulder of the locking bar and carries the locking bar so that through this displacement of the bar the locking clasp swings to open the housing.

In an especially advantageous manner, a window shaped mask is fixed to the printing anvil in the bottom part of the housing and serves to receive a form. Appropriately, the mask is connected to the bottom part of the housing along the longitudinal edge facing the hinge. At the bottom margin of this window, the mask is provided with several bent lugs which extend into apertures in the printing anvil and form a lower stop. Upon opening the housing, the mask is lifted so that the form, or form set, can be easily removed and substituted by another form or set of forms.

In a suitable manner, the upper part of the housing is provided at both sides of the guide track with receiving lugs for the mounting of an ink ribbon box. A ratchet wheel of a latch is coupled to one of the lugs for advancing the ink ribbon.

BRIEF DESCRIPTION OF THE DRAWING

Other details, advantages and characteristics of this invention will become apparent from the following description and by reference to the accompanying figures of the drawing wherein like numbers designate like parts:

FIG. 1 is a partial, cross-sectional view of an embodiment of a printing device embodying the basic principles of the invention.

FIG. 2 is a partial, cross-sectional view of another embodiment of the invention.

DESCRIPTION OF THE PREFERRED EMBODIMENTS

Figure 3:
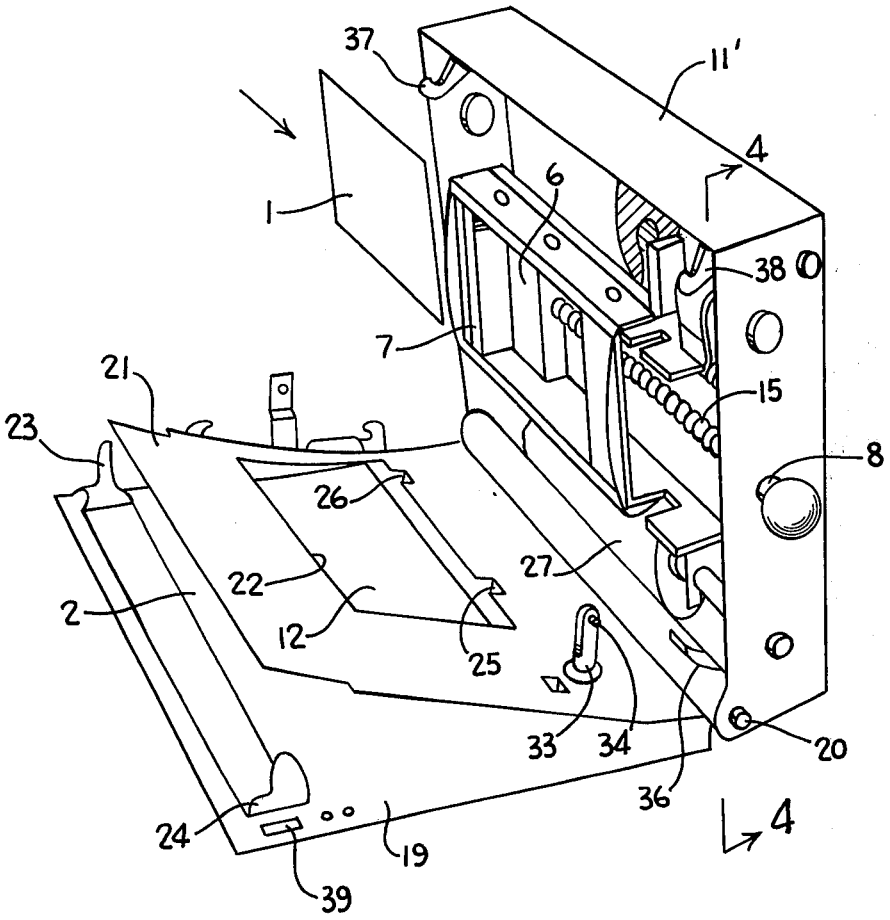
FIG. 3 is a perspective view of a printer incorporating the elements of the invention shown with an open housing.

As can be seen from FIGS. 1 and 2 of the drawing, a printing anvil 2 is arranged within a housing 11 to provide support for a plate 1 having raised characters and preferably made of plastic material. In the embodiment according to FIG. 1, an ink ribbon 3, a document form, or set of forms, 4 and a protective backing layer 5 are arranged above the printing anvil 2. In order to achieve an impression from the characters of the plate 1 onto the form, a printing head 6 is provided from which a small printing ridge 7 extends in order to achieve a high specific surface pressure. The printing ridge is in the form of a pointed member whose apex engages the backing layer 5. The printing head 6 is connected to a pull rod 8 by means of which it can be moved longitudinally as indicated by the arrow in FIG. 1. In order to exert a pressure on the printing head 6, a guide track 9 in the form of a plate is arranged in the housing 11. A plurality of springs 10, 10', 10'' are disposed intermediate the guide track 9 and housing 11 to bias the guide track downwardly. These springs 10, 10', 10'' can be short helical springs or short leaf springs. Alternatively, it is possible to insert lugs made out of rubber, elastic plastic or other suitably resilient material.

Another embodiment, illustrated in FIG. 2, has associated with the printing anvil 2 a foil 12 having a thickness of about 0.2 to 0.4 mm and made out of a soft plastic material having a hardness of about 50 to 90 Shore A, as for example, a polyurethane foil. On this foil 12 a set of forms 4, the ink ribbon 3, and then a plate 1 may be arranged, the latter, of course, having its side with the raised characters arranged downwardly, so that the printing head 6 with its printing ridge 7 is drawn directly across the rear of the plate 1 when the pull rod 8 is actuated. The flexibility of the plate 1 ensures a high surge of pressure in the area of the raised characters of the plate under the printing ridge 7 during the printing operation when the printing head 6 is moved. Experience has shown that by the above arrangements according to FIGS. 1 and 2 imprint without background are attained and, moveover, an especially flat construction of the printing device is achieved.

Figure 4:
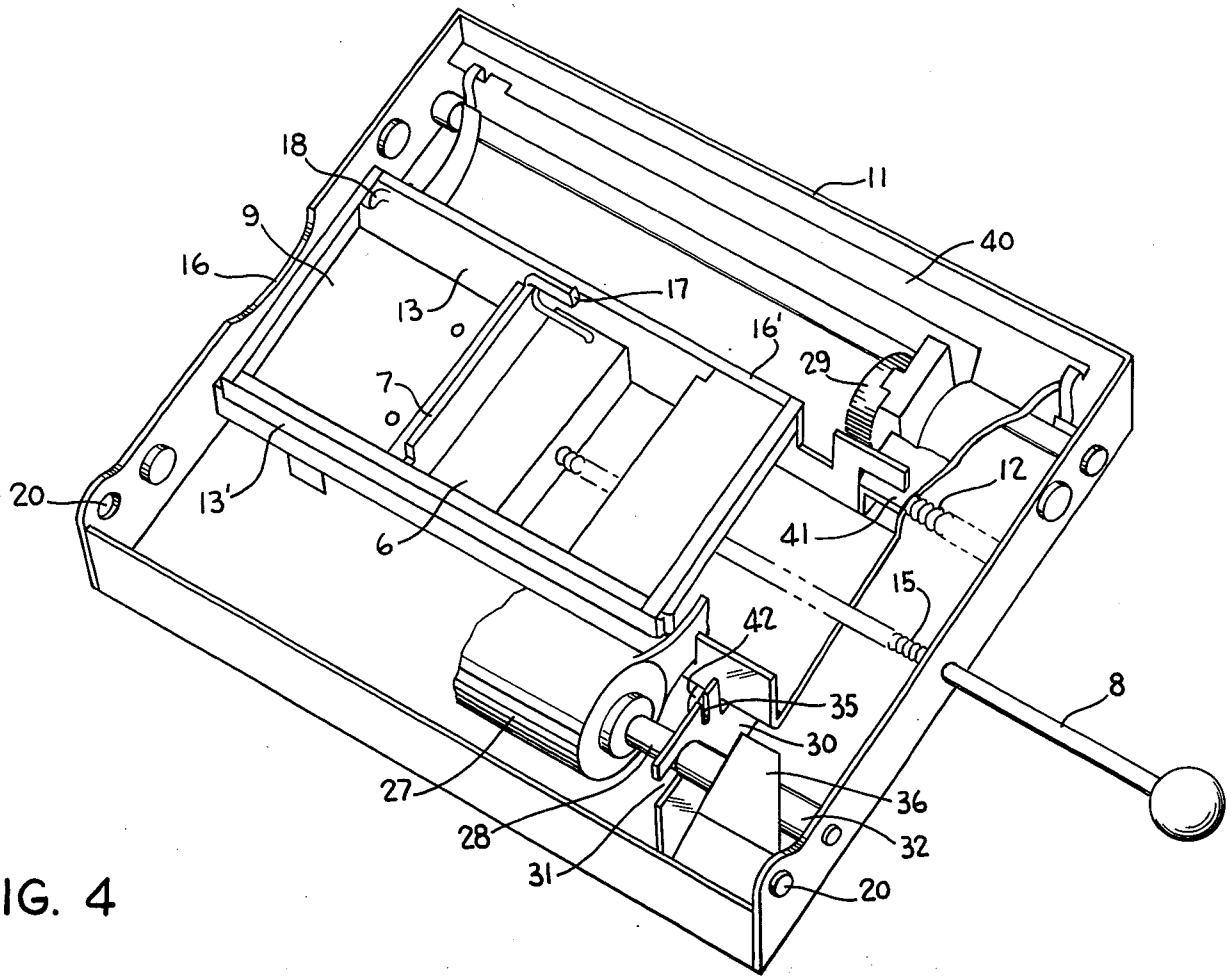
FIG. 4 is an enlarged perspective view of the upper part of the printing housing taken along the lines 4—4 of FIG. 3.

Referring now to FIGS. 3 and 4, the upper part 11' of the housing 11 has a guide track 9 formed as a generally U-shaped plate with legs 13, 13' extending therefrom. The springs 10, 10', 10'', illustrated in FIG. 2, are not shown in the FIG. 4, as they are arranged beneath a span 13'' connecting the legs 13, 13' of the guide track 9. The printing head 6 is movable by hand through the pull rod 8 which projects out of the side of the housing 11. A helical return spring 15 is disposed about the pull rod 8 and is arranged between the side wall of the housing 11 and the printing head 6 for returning the printing head into its home position after the pull rod 8 has been released. The side of the housing opposite the pull rod 8 is provided with an aperture 16 through which the plate 1 may be inserted into the housing between guide rails 16' which are secured to the legs 13, 13' of the guide track 9.

These guide rails 16' may be formed from an L-shaped sheet metal secured to the outer sides of the legs 13, 13', and which L-shaped sheet extends above the associated front surface of the legs 13, 13' a small distance corresponding to the thickness of the plate 1, as illustrated in FIG. 5.

As it is apparent from FIG. 4, a spring-loaded ejector claw 17 is attached to the printing head 6 and extends over the plane of the front surface of both legs 13, 13' in the position as illustrated, so that during the return stroke, i.e. during the movement of the head by the spring 15, the claw engages the plate 1, and ejects it through the aperture 16 in the housing.

In order to assure that the ejector claw does not interfer with the insertion of a new plate to be supported by the legs 13, 13', one leg 13 is provided at its outer end with a knuckle lug 18 which extends into the path of the returning ejector claw 17 in such a way that it is pushed sidewards in the home position of the printing batten 6 to allow the insertion of a new plate 1.

As it is apparent from FIG. 3, the upper part 11' of the housing 11 is connected to the bottom part 19 by means of a hinge 20. At the inner side of the bottom part 19 of the housing 11 the printing anvil 2 together with the foil 12 is arranged, as illustrated in FIG. 2. A mask 21 in the form of a flexible sheet having a window 22 is attached to the bottom part 19 along its longitudinal edge adjacent the hinge 20 as shown in FIG. 3. This mask 21 can be made of thin bronze sheet metal, for example, which assumes a position within the housing over from the printing anvil 2. In this manner, the insertion of a form 4 into the gap between the printing anvil 2 and the mask 21 is facilitated. In order to accurately align the form, the inner side of the bottom part 19 of the housing 11 is provided with projections 23, 24. Moreover, the mask 21 is provided at the bottom margin of its window 22 with several bent lugs 25, 26 which extends into apertures of the printing anvil 2 to form a lower stop for the form 4.

As is apparent from the FIGS. 3 and 4, the upper part 11' of the housing on opposite sides of the guide track 9 has space for arranging an ink ribbon box 27. In order to mount the ink ribbon box 27, receiving lugs 28, or the like, are provided (one being shown). A ratchet wheel 29 is connected to one of the lugs 28 to provide a means for incremental feeding of the ink ribbon. Included is a guide sheet 30 which extends below the guide track 9 and is provided with a recess 31 through which a socket 32 is shiftably mounted. As illustrated in FIG. 3, a lug 33 is mounted at the bottom part 19 of the housing which is provided with an axial recess which is dimensioned to correspond to the thickness of the guide sheet 30. A pin 34 is attached to the lug 33 and is operative to be received within the recess 31. When the housing is opened or closed, i.e., when the parts 11 and 19 of the housing are moved towards and away from one another, the pin 34 engages recess 35 of the guide sheet 30 and causes a shifting of the guide sheet 30. Through a leaf spring 42 (only partially shown), which is connected to the guide sheet 30, which causes a feeding of the ratchet wheel 29 upon removal of the pin 34.

As is apparent from FIGS. 3 & 4, adjacent to the hinge 20 is a leaf spring 36 which exerts a separating force, on both parts 11, 19 of the housing. When the housing is in its closed position, two locking latches 37, 38 are pivotally mounted at the upper part 11' of the housing and are operative to be received within corresponding apertures 39 (only one being shown) in the bottom side 19 of the housing. In order to control the swinging movement of the locking latches 37, 38, a locking bar 40 is shiftably mounted in the housing which cooperates with the locking latches during its shifting so that the shifting movement of the locking bar 40 is transformed into a swinging movement of the locking latches 37, 38. In order to attain an automatic opening of the housing after the impression of the plate has been performed, the locking bar 40 is provided with a shoulder 41 which extends into the advance path of the printing head 6. When the pull rod 8 is completely drawn, the printing head 6 abuts the shoulder 41 and takes the shoulder 41 along with the locking bar 40 from under the compression of a compression spring 42. When the pull rod 8 together with the printing head 6 returns to its home position, the compression spring 42 relieves the tension and moves the locking bar 40 back into its home position.

What is claimed is:

1. In a portable, manual printer of the type wherein the printing operation is accomplished by a printing plate being impressed upon a print medium such as a sheet of paper or set of forms, the combination comprising:

a housing having an opening therein;

a longitudinally extending guide track received within said housing and having one end adjacent to said opening;

a printing anvil formed within said housing opposite said guide track;

means for holding a printing plate in registration with and intermediate to said guide track and said printing anvil;

means for supporting a print medium intermediate said guide track and said printing anvil;

a printing head having a non-rotatable, apex forming ridge extending therefrom slidingly supported by said guide track with said ridge directed toward said anvil;

biasing means disposed intermediate said housing and said guide track to bias said print head toward said anvil;

a rod secured to said printing head and extending outside said housing;

resilient means disposed about said rod intermediate said printing head and said housing for biasing said printing head toward said opening; and means attached to said printing head for at least partially removing a printing plate from said housing upon completion of the printing operation comprising an engaging member attached to said printing head, means for holding said engaging member away from said printing plate holding means when said printing head is slid by said rod away from said opening and means for placing said engaging member within said printing plate holding means when said resilient means biases said print head toward said opening.

2. The printer of claim 1 including means supported within said housing for supporting an ink ribbon intermediate said printing plate holding means and said print medium support means.

3. In a portable, manual printer of the type wherein the printing operation is accomplished by a printing plate being impressed upon a print medium such as a sheet of paper or a set of forms, the combination comprising:

a housing made of two parts which are pivotably connected to one another, there being an aperture in one part providing an opening to the housing when said two parts are adjacent one another;

a longitudinally extending guide track received with said housing and having one end adjacent to said opening;

a printing anvil formed within the second part of said housing opposite said guide track;

a flexible sheet having a window therein and secured at one end of said housing parts, said window being located at said anvil;

a printing head having a non-rotatable, apex forming ridge extending therefrom in the form of a pointed member disposed intermediate said guide track and said printing anvil with the apex of said ridge directed toward said anvil;

means for holding a printing plate intermediate to and in registration with said printing head and said printing anvil;

biasing means disposed intermediate said housing and said guide track to bias said print head toward said anvil;

a rod secured to said printing head and extending outside said housing;

resilient means disposed about said rod intermediate said printing head and said housing for biasing said printing head toward said opening; and means attached to said printing head for at least partially removing a printing plate from said housing upon completion of the printing operation comprising an engaging member attached to said printing head, means for holding said engaging member away from said printing plate holding means when said printing head is slid by said rod away from said opening and means for placing said engaging means within said printing plate holding means when said resilient means biases said print head toward said opening.

4. The printer of claim 3 including a releasable locking means for holding said two housing parts together.

* * * * *